US011479976B2

(12) United States Patent
Ylikangas et al.

(10) Patent No.: US 11,479,976 B2
(45) **Date of Patent: *Oct. 25, 2022**

(54) PANEL WITH LOCKING DEVICE

(71) Applicant: Välinge Innovation AB, Viken (SE)

(72) Inventors: Roger Ylikangas, Lerberget (SE); Anders Nilsson, Helsingborg (SE); Thomas Meijer, Viken (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/031,166

(22) Filed: Sep. 24, 2020

(65) Prior Publication Data

US 2021/0087834 A1 Mar. 25, 2021

(30) Foreign Application Priority Data

Sep. 25, 2019 (SE) ..... SE1951086-6

(51) Int. Cl.
*E04F 15/02* (2006.01)
*E04F 15/10* (2006.01)

(52) U.S. Cl.
CPC .. *E04F 15/02038* (2013.01); *E04F 15/02033* (2013.01); *E04F 15/102* (2013.01); (Continued)

(58) Field of Classification Search
CPC ..... E04F 15/02038; E04F 13/0894; E04F 2201/041
See application file for complete search history.

(56) References Cited

U.S. PATENT DOCUMENTS 7,051,486 B2 5/2006 Pervan
7,454,875 B2 11/2008 Pervan et al.
(Continued)

FOREIGN PATENT DOCUMENTS

DE 200 00 484 U1 5/2000
DE 202 03 311 U1 5/2002
(Continued)

OTHER PUBLICATIONS

U.S. Appl. No. 16/253,465, Darko Pervan and Marcus Nilsson Ståhl, filed Jan. 22, 2019.
(Continued)

*Primary Examiner* — Gisele D Ford
(74) *Attorney, Agent, or Firm* — Buchanan Ingersoll & Rooney P.C.

(57) ABSTRACT

A set of panels includes first and second panels and a mechanical locking device for assembly by vertical relative displacement of the panels. A locking strip extends from a first edge of the first panel in a direction parallel to first and second panel surfaces of the first panel. The locking strip includes a locking strip edge, and first and second locking strip surfaces respectively extending in directions substantially corresponding to those of the first and second panel surfaces. A locking element of the locking strip cooperates with a locking groove at the second edge of the second panel for locking in a direction parallel to the first panel surface. Opposite edges respectively include cooperating tongue and tongue groove for vertical locking. A flexing groove extends from a first locking strip surface/first edge transition and into the first panel at an angle α from the first panel surface.

25 Claims, 4 Drawing Sheets

(52) U.S. Cl.
CPC .... *E04F 15/105* (2013.01); *E04F 2201/0146* (2013.01); *E04F 2201/023* (2013.01); *E04F 2201/042* (2013.01)

(56) References Cited

U.S. PATENT DOCUMENTS 7,584,583 B2 9/2009 Bergelin et al.
7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,365,499 B2 2/2013 Nilsson et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,756,899 B2 6/2014 Nilsson et al.
8,763,341 B2 7/2014 Pervan
8,769,905 B2 7/2014 Pervan
8,776,473 B2 7/2014 Pervan et al.
8,806,832 B2 8/2014 Kell
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,103,126 B2 8/2015 Kell
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,249,581 B2 2/2016 Nilsson et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,047,527 B2 8/2018 Nilsson et al.
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,526,793 B2 1/2020 Nilsson et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo
10,828,798 B2 11/2020 Fransson
10,933,592 B2 3/2021 Blomgren et al.
10,934,721 B2 3/2021 Pervan et al.
10,953,566 B2 3/2021 Fransson et al.
10,968,639 B2 4/2021 Pervan et al.
10,975,577 B2 4/2021 Pervan et al.
10,995,501 B2 5/2021 Pervan
11,045,933 B2 6/2021 Fransson et al.
11,053,691 B2 7/2021 Pervan
11,053,692 B2 7/2021 Pervan
11,060,302 B2 7/2021 Ylikangas et al.
11,066,835 B2 7/2021 Boo
2003/0205017 A1* 11/2003 Palmberg ..... E04F 15/02 52/592.1
2004/0016196 A1 1/2004 Pervan
2005/0160694 A1 7/2005 Pervan
2005/0021081 A1 9/2005 Pervan
2006/0053724 A1* 3/2006 Braun ..... B05D 5/10 52/578
2006/0070333 A1 4/2006 Pervan
2006/0101769 A1 5/2006 Pervan
2006/0236642 A1 10/2006 Pervan
2006/0260254 A1 11/2006 Pervan et al.
2008/0000186 A1 1/2008 Pervan et al.

(56) References Cited

U.S. PATENT DOCUMENTS

2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1 5/2009 Pervan et al.
2009/0193748 A1 8/2009 Boo et al.
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0056167 A1 3/2011 Nilsson et al.
2011/0088344 A1 4/2011 Pervan et al.
2011/0088345 A1 4/2011 Pervan
2011/0154763 A1 6/2011 Bergelin et al.
2011/0167750 A1 7/2011 Pervan
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0174520 A1 7/2012 Pervan
2012/0279161 A1 11/2012 Håkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111758 A1 5/2013 Nilsson et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1 10/2013 Boo
2013/0318906 A1 12/2013 Pervan et al.
2014/0007539 A1 1/2014 Pervan et al.
2014/0020324 A1 1/2014 Pervan
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0190112 A1 7/2014 Pervan
2014/0208677 A1 7/2014 Pervan et al.
2014/0223852 A1 8/2014 Pervan
2014/0237924 A1 8/2014 Nilsson et al.
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0325930 A1* 11/2014 Schneider ..... E04F 15/02038 52/588.1
2014/0366476 A1 12/2014 Pervan
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2015/0368910 A1 12/2015 Kell
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0108624 A1 4/2016 Nilsson et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelöv
2017/0037641 A1 2/2017 Nygren et al.
2017/0081860 A1 3/2017 Boo
2017/0254096 A1 9/2017 Pervan
2017/0321433 A1 11/2017 Pervan et al.
2017/0362834 A1 12/2017 Pervan et al.
2018/0001509 A1 1/2018 Myllykangas et al.
2018/0001510 A1 1/2018 Fransson
2018/0001573 A1 1/2018 Blomgren et al.
2018/0002933 A1 1/2018 Pervan
2018/0002935 A1 1/2018 Devos
2018/0016783 A1 1/2018 Boo
2018/0030737 A1 2/2018 Pervan
2018/0030738 A1 2/2018 Pervan
2018/0094441 A1 4/2018 Boo
2018/0119429 A1* 5/2018 Schulte ..... E04F 15/02038
2018/0119431 A1 5/2018 Pervan et al.
2018/0178406 A1 6/2018 Fransson et al.
2018/0313093 A1 11/2018 Nilsson et al.
2019/0024387 A1 1/2019 Pervan
2019/0048592 A1 2/2019 Boo
2019/0048596 A1 2/2019 Pervan
2019/0063076 A1 2/2019 Boo et al.
2019/0093370 A1 3/2019 Pervan et al.
2019/0093371 A1 3/2019 Pervan
2019/0119928 A1 4/2019 Pervan et al.
2019/0127989 A1 5/2019 Kell
2019/0127990 A1 5/2019 Pervan et al.
2019/0145108 A1* 5/2019 Hannig ..... E04F 15/102 52/582.2
2019/0169859 A1 6/2019 Pervan et al.
2019/0232473 A1 8/2019 Fransson et al.
2019/0271165 A1 9/2019 Boo
2019/0376298 A1 12/2019 Pervan et al.
2019/0394314 A1 12/2019 Pervan et al.
2020/0087927 A1 3/2020 Pervan
2020/0102756 A1 4/2020 Pervan
2020/0109569 A1 4/2020 Pervan
2020/0149289 A1 5/2020 Pervan
2020/0173175 A1 6/2020 Pervan
2020/0224430 A1 7/2020 Ylikangas et al.
2020/0232225 A1* 7/2020 Fahle ..... E04F 13/0894

(56) References Cited

U.S. PATENT DOCUMENTS

| | | | |
|---|---|---|---|
| 2020/0263437 | A1 | 8/2020 | Pervan |
| 2020/0284045 | A1 | 9/2020 | Kell |
| 2020/0318667 | A1 | 10/2020 | Derelöv |
| 2020/0354969 | A1 | 11/2020 | Pervan et al. |
| 2020/0362567 | A1 | 11/2020 | Nilsson et al. |
| 2020/0412852 | A9 | 12/2020 | Pervan et al. |
| 2021/0016465 | A1 | 1/2021 | Fransson |
| 2021/0047840 | A1 | 2/2021 | Pervan |
| 2021/0047841 | A1 | 2/2021 | Pervan et al. |
| 2021/0071428 | A1 | 3/2021 | Pervan |
| 2021/0087831 | A1 | 3/2021 | Nilsson et al. |
| 2021/0087832 | A1 | 3/2021 | Boo |
| 2021/0087833 | A1 | 3/2021 | Ylikangas et al. |

FOREIGN PATENT DOCUMENTS

| | | | |
|---|---|---|---|
| DE | 20 2016 105 667 | U1 | 11/2016 |
| DE | 20 2018 006 151 | U1 | 5/2019 |
| WO | WO 2016/113676 | A1 | 7/2016 |
| WO | WO 2018/063047 | A1 | 4/2018 |

OTHER PUBLICATIONS

U.S. Appl. No. 16/708,719, Darko Pervan, filed Dec. 10, 2019.
U.S. Appl. No. 16/745,613, Darko Pervan, filed Jan. 17, 2020.
U.S. Appl. No. 16/881,129, Richard William Kell, filed May 22, 2020.
U.S. Appl. No. 17/029,658, Anders Nilsson, Karl Quist, Roger Ylikangas and Fredrik Boo, filed Sep. 23, 2020.
U.S. Appl. No. 17/030,923, Christian Boo, filed Sep. 24, 2020.
U.S. 17/030,966, Roger Ylikangas and Thomas Meijer, filed Sep. 24, 2020.
U.S. Appl. No. 17/368,075, Richard William Kell, filed Jul. 6, 2021.
International Search Report and Written Opinion dated Nov. 3, 2020 in PCT/IB2020/058922, ISA/SE Patent-och registreringsverket, Stockholm, SE, 11 pages.
Kell, Richard William, U.S. Appl. No. 17/368,075 entitled "Vertical Joint System and Associated Surface Covering System," filed in the U.S. Patent and Trademark Office filed Jul. 6, 2021.

* cited by examiner

PANEL WITH LOCKING DEVICE

CROSS REFERENCE TO RELATED APPLICATIONS

The present application claims the benefit of Swedish Application No. 1951086-6, filed on Sep. 25, 2019. The entire contents of Swedish Application No. 1951086-6 are hereby incorporated herein by reference in their entirety.

TECHNICAL FIELD

Embodiments of the present disclosure relate to panels configured to be locked together with a mechanical locking device. The panels may be floorboards configured to be locked together to obtain a floor product.

TECHNICAL BACKGROUND

Panels are known that are configured to be assembled by a vertical displacement and to be locked together in a vertical direction and in a horizontal direction. Such panels are disclosed in e.g., WO 2018/063047. A tongue and groove connection locks a first edge of a first panel to a second edge of the second panel. The first edge and the second edge furthermore comprise a locking element configured to cooperate with a locking groove for locking in the vertical direction and the horizontal direction.

The above description of various known aspects is the applicant's characterization of such, and is not an admission that any of the above description is considered as prior art.

Embodiments of the present disclosure address a need to provide panels that can be easily assembled.

SUMMARY

It is an object of certain aspects of the present disclosure to provide an improvement over the above described techniques and known art.

A further object of at least certain aspects of the present disclosure is to facilitate the assembling of panels configured to be assembled by a vertical displacement or an angling motion and locked together in the vertical direction and the horizontal direction.

A further object of at least certain aspects of the present disclosure is to facilitate assembling of panels configured to be assembled in a way that reduces a force and impact needed from a person when assembling the panels.

According to a first aspect there is provided a set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending in a direction substantially corresponding to the direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, characterized in that the mechanical locking device comprises a flexing groove extending from a transition between the first locking strip surface and the first edge and into the first panel at an angle $\alpha$ from the first panel surface, and that the locking strip is configured to flex by varying a shape of the flexing groove during the assembly, thereby increasing a flexibility of the locking strip during the assembly.

According to another aspect there is provided a set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending in a direction substantially corresponding to the direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, characterized in that the mechanical locking device comprises a flexing groove extending from a transition between the first locking strip surface and the first edge and into the first panel at an angle $\alpha$ from the first panel surface, wherein the angle $\alpha$ is within the range of about 0° to about 30°, preferably within the range of about 0° to about 20°, more preferably within the range of about 0° to about 10°, even more preferably within the range of about 0° to about 5°, and that the locking strip is configured to flex by varying a shape of the flexing groove during the assembly, thus increasing a flexibility of the locking strip during the assembly.

According to an aspect an opening of the flexing groove has a width T.

According to an aspect the width T of the opening of the flexing groove is within the range of about 0.6 mm to about 2.5 mm, preferably about 0.8 mm to about 2.0 mm, more preferably 1.6 mm.

According to an aspect a ratio between the width T of the opening of the flexing groove and a distance Q between the first panel surface and the second panel surface is within the range of about 0.05 to about 0.4, preferably about 0.1 to about 0.3, more preferably about 0.15 to about 0.2.

According to an aspect the flexing groove has a depth D that is within the range of about 2.5 mm to about 15 mm, preferably about 4 mm to about 12 mm, more preferably about 5 mm to about 10 mm, even more preferably about 7 mm.

According to an aspect a ratio between the depth D of the flexing groove and the width T of the flexing groove is about 2 to about 10, preferably about 3 to about 7, more preferably about 4.

According to an aspect the flexing groove has a bottom.

According to an aspect a ratio between a length M of the bottom of the flexing groove and the width T of the opening of the flexing groove is within the range of about 0.5 to about 2, preferably about 0.8 to about 1.4, more preferably about 1 to about 1.25.

According to an aspect the first locking strip edge is positioned at a distance Z from the first edge, wherein Z is within the range of about 4 mm to about 12 mm, preferably about 6 mm to about 9 mm, more preferably about 7.5 mm to about 8.5 mm.

According to an aspect a ratio between the distance Z and the width T of the opening of the flexing groove is within the range of about 2 to about 10, preferably about 4 to about 6, more preferably about 5.

According to an aspect the flexing groove has a length L.

According to an aspect the first panel comprises a third edge and a fourth edge, the third edge being at a distance TL from the fourth edge.

According to an aspect the length L of the flexing groove extends from the third edge of the first panel to the fourth edge of the first panel.

According to an aspect the flexing groove has a fifth edge and a sixth edge, the fifth edge being positioned at a distance X from the third edge and the sixth edge being positioned at a distance X from the fourth edge.

According to an aspect the distance X is within the range of about 1 mm to about 30 mm, preferably about 5 mm to about 20 mm, more preferably about 10 mm.

According to an aspect the bottom of the flexing groove is essentially arch shaped.

According to an aspect the bottom of the flexing groove is essentially triangular.

According to an aspect a cross-sectional shape of the flexing groove is essentially rectangular or square.

According to an aspect the opening of the flexing groove that is connected to the first edge is positioned at a distance A1 in a vertical direction from the first panel surface.

According to an aspect the distance A1 is within the range of about 2 mm to about 7 mm, preferably about 3 mm to about 6 mm, more preferably about 4 mm to about 5 mm.

According to an aspect the bottom of the flexing groove is positioned at a distance A3 in a vertical direction from the second panel surface.

According to an aspect the distance A3 is within the range of about 1 mm to about 7 mm, preferably about 1.25 mm to about 3 mm, more preferably about 1.5 mm to about 2 mm.

According to an aspect the flexing groove extends a distance A2 in a direction essentially perpendicular to the second panel surface, wherein A2 is equal to the distance Q minus distance A1 minus distance A3 ((Q)−(A1)−(A3)).

According to an aspect a ratio between the distance A2 and the distance A3 is about 0.8 to about 3, preferably about 1 to about 2, more preferably about 1.25 to about 1.75.

According to an aspect a ratio between the distance A2 and the distance A1 is about 0.3 to about 1.2, preferably about 0.4 to about 0.9, more preferably about 0.5.

According to an aspect a ratio between the sum of distance A2 plus distance A3 and the distance Q (((A2)+(A3))/(Q)) is about 0.2 to about 0.5, preferably about 0.25 to about 0.40, more preferably about 0.30 to about 0.35.

According to an aspect the mechanical locking device is configured to lock the first panel and the second panel in a first direction parallel to the first panel surface and/or in a second direction perpendicular to the first panel surface.

According to an aspect the core of the first panel and/or of the second panel may be a wood-based core, preferably made of MDF, HDF, OSB, WPC, plywood or particleboard. The core may also be a plastic core comprising thermosetting plastic or thermoplastic e.g., vinyl, PVC, PU or PET. The plastic core may comprise fillers. The core may also be mineral based board which may comprise e.g., MgO.

The first panel and/or the second panel may also be of solid wood.

The first panel and/or the second panel may be provided with a decorative layer, such as a foil or a veneer, on one or more surfaces.

BRIEF DESCRIPTION OF THE DRAWINGS

These and other aspects, features and advantages of which embodiments of the disclosure are capable of, will be apparent and elucidated from the following description of embodiments and aspects of the present disclosure, reference being made to the accompanying drawings.

DETAILED DESCRIPTION

Figure 1A:
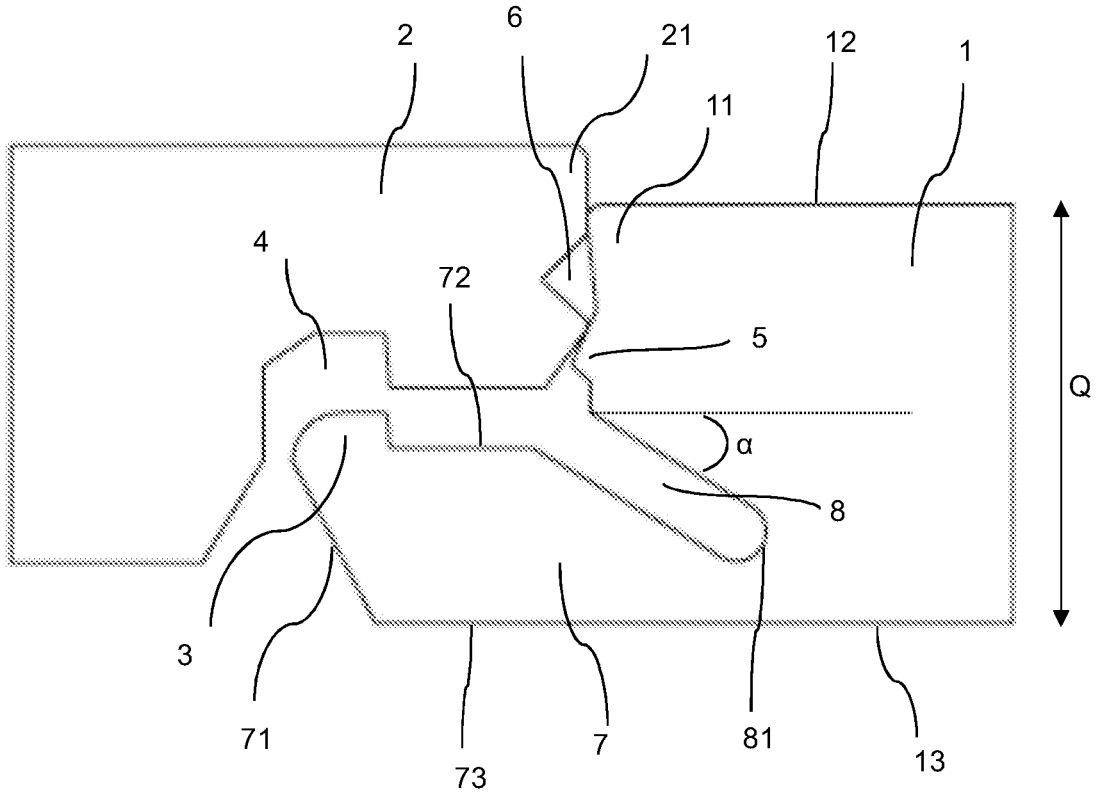
FIG. 1A shows a side view of an illustrative set in an unassembled state, where the bottom of the flexing groove is essentially arch shaped.

Specific embodiments of the disclosure will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the disclosure to those skilled in the art. The terminology used in the detailed description of the embodiments illustrated in the accompanying drawings is not intended to be limiting of the invention. In the drawings, like numbers refer to like elements.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example aspects may be implemented at least in part by means of both hardware and software, and that several "means", "units" or "devices" may be represented by the same item of hardware.

The different aspects, alternatives and embodiments of the disclosure herein can be combined with one or more of the other aspects, alternatives and embodiments described herein. Two or more aspects can be combined.

A first aspect of the disclosure is shown, e.g., in FIGS. 1A-3, which show illustrative sets of panels comprising a first panel 1, a second panel 2 and a mechanical locking device for locking the first panel 1 to the second panel 2. The mechanical locking device is configured for an assembly by a displacement of the second panel 2 in relation to the first panel 1 in a vertical direction to obtain a locked position of the first panel 1 and the second panel 2.

The first panel 1 comprises a first edge 11, a first panel surface 12 and a second panel surface 13. The second panel 2 comprises a second edge 21. The mechanical locking device comprises a locking strip 7 extending from the first edge 11 in a direction parallel to the first and second panel surfaces 12,13, wherein the locking strip 7 comprises a locking strip edge 71, wherein the locking strip 7 comprises a first locking strip surface 72 extending in a direction substantially corresponding to the direction of the first panel surface 12 of the first panel 1, wherein the locking strip 7 comprises a second locking strip surface 73 extending in a direction substantially corresponding to direction of the second panel surface 13 of the first panel 1, and wherein the locking strip 7 comprises a locking element 3 configured to cooperate with a locking groove 4 at the second edge 21 of the second panel 2 for locking in a direction parallel to the first panel surface 12. By "substantially corresponding" it is meant that the noted directions may form an angle within a range of +/−10 degrees. One of the first or second edge 11,21 comprises a tongue 5 configured to cooperate with a tongue groove 6 at the other one of the first or second edge 11,21 for locking in a vertical direction. The set is characterized in that the mechanical locking device comprises a flexing groove 8 extending from a transition between the first locking strip surface 72 and the first edge 11 and into the first panel 1 at an angle α from the first panel surface 12, and that the locking strip 7 is configured to flex by varying a shape of the flexing groove 8 during the assembly, thereby increasing a flexibility of the locking strip 7 during the assembly.

In one aspect the angle α is within the range of about 0° to about 30°, preferably within the range of about 0° to about 20°, more preferably within the range of about 0° to about 10°, even more preferably within the range of about 0° to about 5°, and the flexing groove 8 is configured to increase a flexibility of the locking strip 7 during the assembly. A smaller angle α may be preferred for panels with a smaller thickness Q to allow for a first flexing groove 8 with a greater depth D.

The increased flexibility of the locking strip 7 during assembly results in an increased distance between the first edge 11 and the locking element 3. This results in an easier assembly of the first 1 and second 2 panels.

The first panel 1 and the second panel 2 are preferably floorboards to be locked together to obtain a floor product.

An opening of the flexing groove 8 may have a width T. The width T of the opening of the flexing groove 8 may be within the range of about 0.6 mm to about 2.5 mm, preferably about 0.8 mm to about 2.0 mm, more preferably about 1.6 mm. The values are high enough to allow an easy assembling and low enough to allow a sufficient locking strength. A width T of 2 mm may provide an easier assembling and width T of 0.6 mm may provide a higher locking strength. The preferred value can depend on e.g. the material of the locking strip. A greater width may have the advantage that the risk for cracks are reduced, particularly for brittle materials, such as HDF and plastic material with a high amount of fillers.

A ratio between the width T of the opening of the flexing groove 8 and a distance Q between the first panel surface 12 and the second panel surface 13 may be within the range of about 0.05 to about 0.4, preferably about 0.1 to about 0.3, more preferably about 0.15 to about 0.2. The ratios are high enough to allow an easy assembling and low enough to allow a sufficient locking strength. A ratio of 0.4 may provide an easier assembling and a ratio of 0.05 may provide a higher locking strength. The preferred value can depend on e.g. the material of the locking strip. A greater ratio may have the advantage that the risk for cracks are reduced, particularly for brittle materials, such as HDF and plastic material with a high amount of fillers.

The flexing groove 8 may have a depth D that may be within the range of about 2.5 mm to about 15 mm, preferably about 4 mm to about 12 mm, more preferably about 5 mm to about 10 mm, even more preferably about 7 mm. The values are high enough to allow an easy assembling and low enough to allow a sufficient locking strength. A depth D of 15 mm may provide an easier assembling and depth D of 2.5 mm may provide a higher locking strength. The preferred value can depend on e.g. the material of the locking strip.

A ratio between the depth D of the flexing groove 8 and the width T of the flexing groove 8 may be about 2 to about 10, preferably about 3 to about 7, more preferably about 4. The ratios are high enough to allow an easy assembling and low enough to allow a sufficient locking strength. A ratio of 10 may provide an easier assembling and a ratio of 2 may provide a higher locking strength. The preferred value can depend on e.g. the material of the locking strip.

Figure 1B:
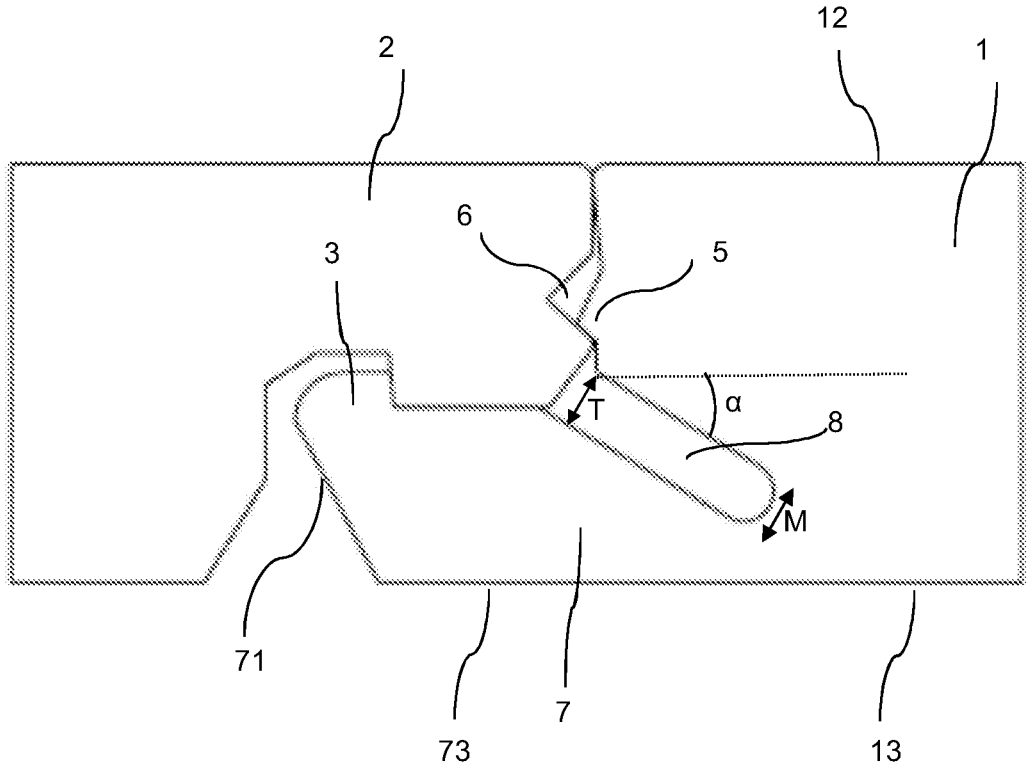
FIG. 1B shows a side view of an illustrative set in an assembled state, where the bottom of the flexing groove is essentially arch shaped.
Figure 2A:
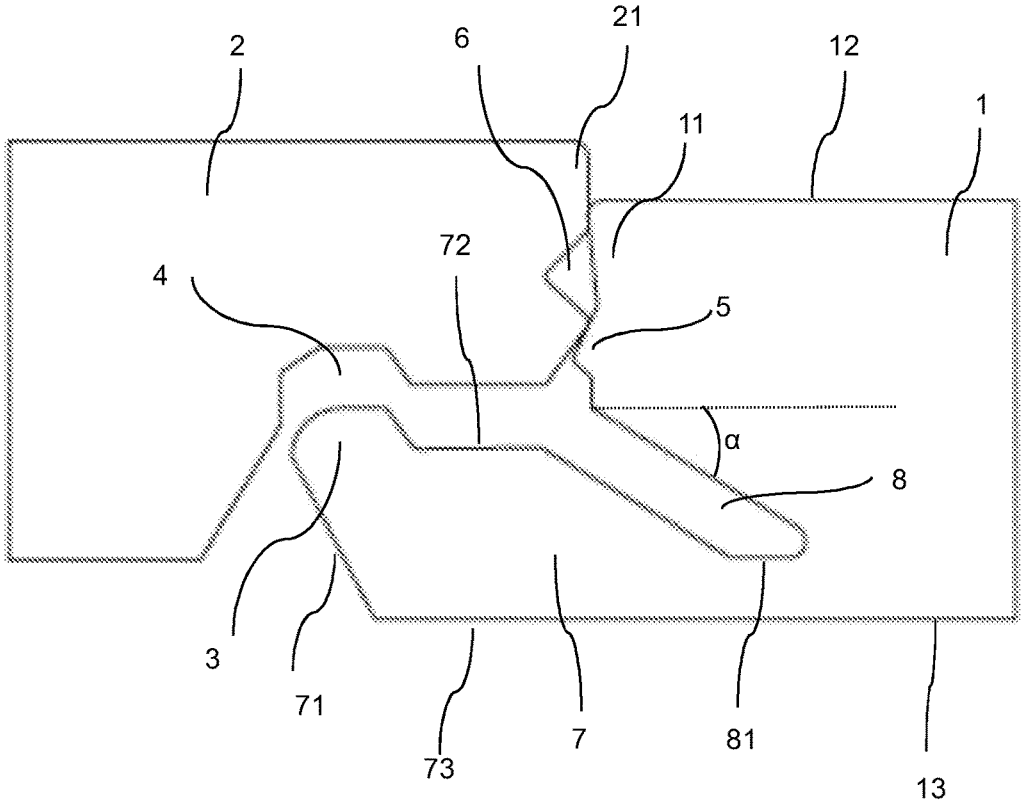
FIG. 2A shows a side view of an illustrative set in an unassembled state, where the bottom of the flexing groove is essentially triangular.
Figure 2B:
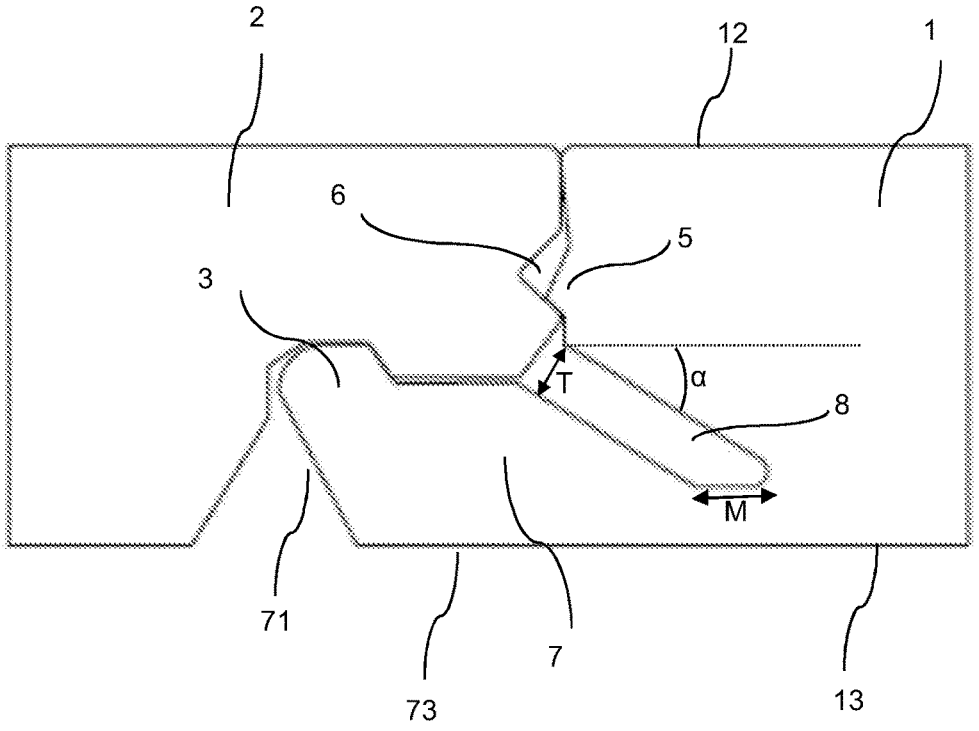
FIG. 2B shows a side view of an illustrative set in an assembled state, where the bottom of the flexing groove is essentially triangular.

The flexing groove 8 may have a bottom 81. A ratio between a length M of the bottom 81 of the flexing groove 8 and the width T of the opening of the flexing groove 8 may be within the range of about 0.5 to about 2, preferably about 0.8 to about 1.4, more preferably about 1 to about 1.25. The ratios are high enough to allow an easy assembling and low enough to allow a sufficient locking strength. A ratio of 1.4, as shown in FIG. 2B, may provide an easier assembling and a ratio of 1, as shown in FIG. 1B, may provide a higher locking strength. The preferred value can depend on e.g. the material of the locking strip.

The first locking strip edge 71 may be positioned at a distance Z from the first edge 11, wherein Z is within the range of about 4 mm to about 12 mm, preferably about 6 mm to about 9 mm, more preferably about 7.5 mm to about 8.5 mm. A greater distance Z may allow a greater flexibility and an easier assembling.

A ratio between the distance Z and the width T of the opening of the groove flexing 8 may be within the range of about 2 to about 10, preferably about 4 to about 6, more preferably about 5. A greater distance Z may allow the same flexibility for a smaller width T.

Figure 4A:
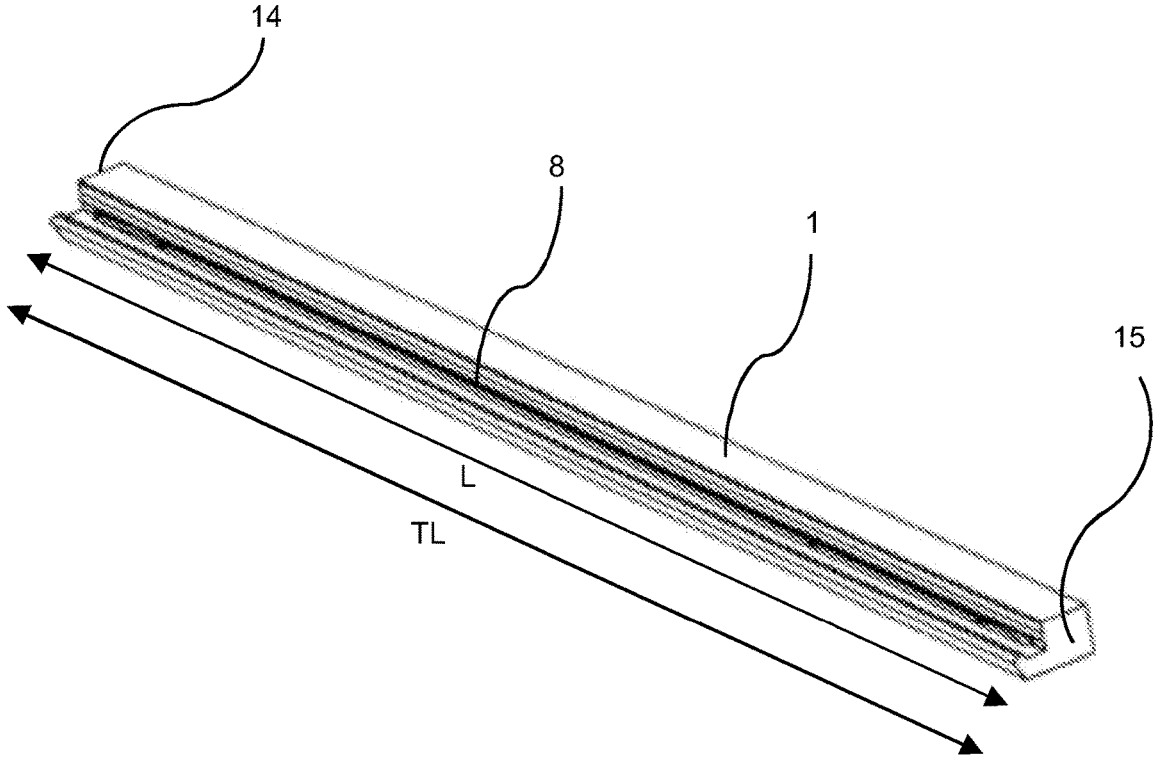
FIG. 4A shows a view of an illustrative first panel comprising a flexing groove which extends over the whole length of the first panel.
Figure 4B:
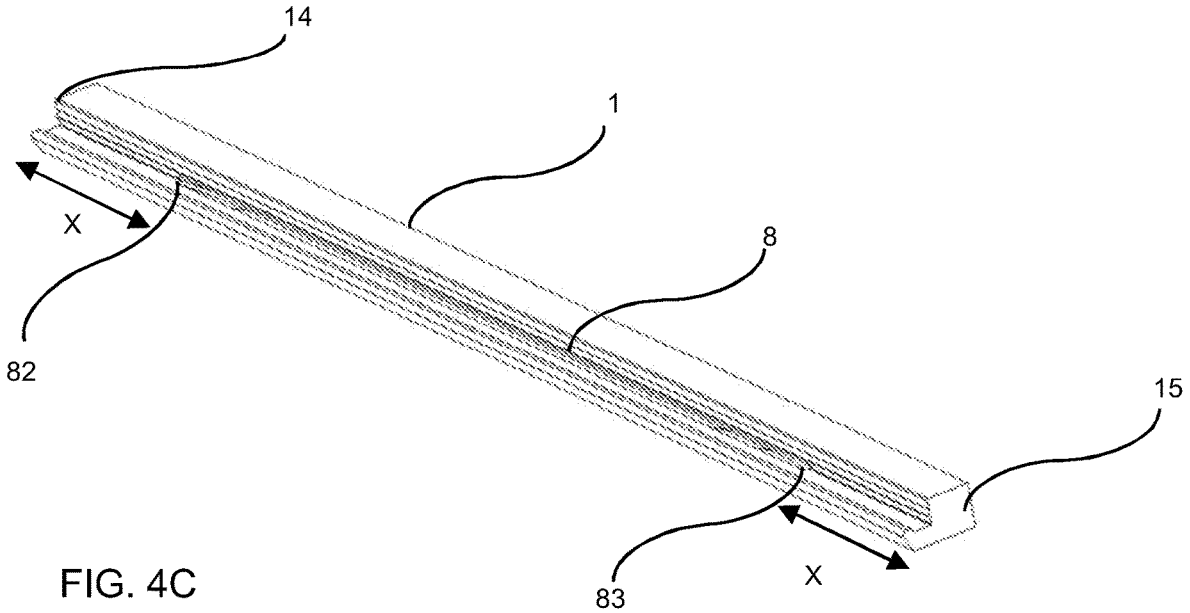
FIG. 4B shows a side view of an illustrative first panel comprising a flexing groove which does not extend the whole length of the first panel, but which extends a distance X from the third edge of the first panel to a distance X from the fourth edge of the first panel.
Figure 4C:
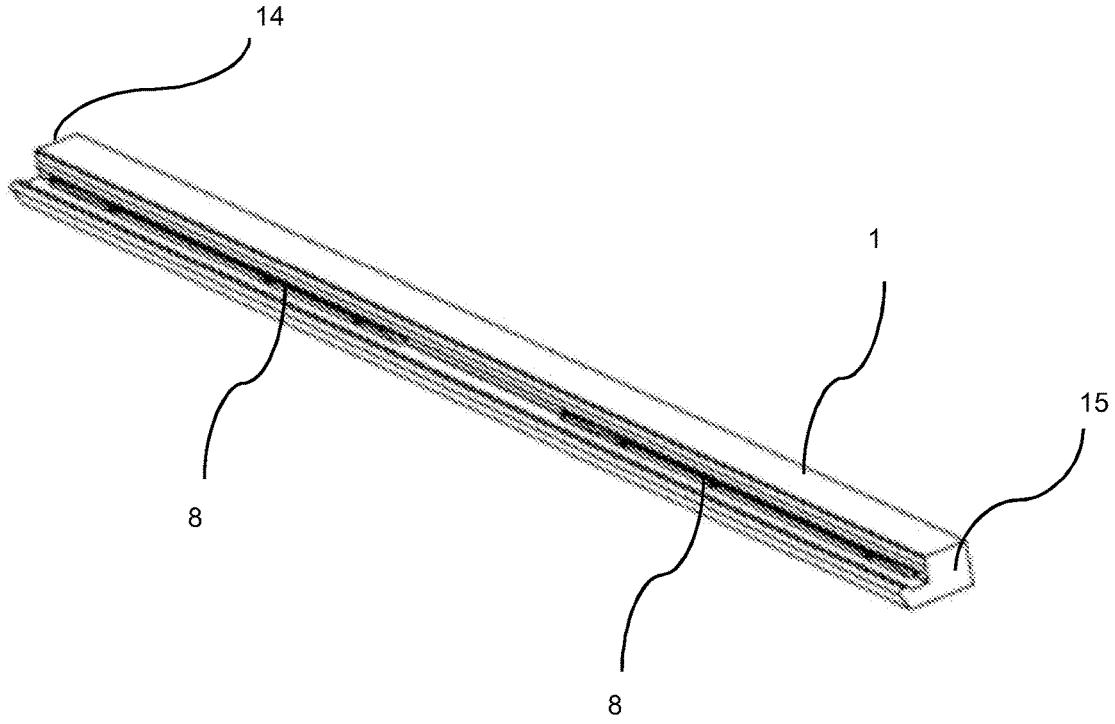
FIG. 4C shows an illustrative embodiment of a first panel comprising flexing groove which is not continuous, but which is divided into two or more flexing grooves running in line with a space between them.

Illustrative aspects of the first panel 1 are shown in FIGS. 4A-4C.

The flexing groove 8 may have a length L.

The first panel 1 may comprise a third edge 14 and a fourth edge 15, the third edge 14 being at a distance TL from the fourth edge 15.

The length L of the flexing groove 8 may extend from the third edge 14 of the first panel 1 to the fourth edge 15 of the first panel 1, such that L=TL, as shown in FIG. 4A.

As shown for example in FIG. 4B, the flexing groove 8 may have a fifth 82 edge and a sixth 83 edge, where the fifth edge 82 may be positioned at a distance X from the third 14 edge and the sixth edge 83 may be positioned at a distance X from the fourth edge 15. The distance X may be within the range of about 1 mm to about 30 mm, preferably about 5 mm to about 20 mm, more preferably about 10 mm. According to this aspect, the flexing groove 8 does not extend over the whole distance TL from the third edge 14 to the fourth edge 15 of the first panel 1.

As shown for example in FIG. 4C, in one aspect the flexing groove is not continuous over the first panel 1, but may be divided into two or more flexing grooves 8 with a space between them. These flexing grooves 8 can be spaced apart and collinear. In one aspect the space between said two or more flexing grooves 8 may be within the range of about 1 mm to about 30 mm.

In one aspect the bottom 81 of the flexing groove 8 may be essentially arch shaped.

In one aspect the bottom 81 of the flexing groove 8 may be essentially triangular.

In one aspect a cross-sectional shape of the flexing groove 8 may be essentially rectangular or square.

Figure 3:
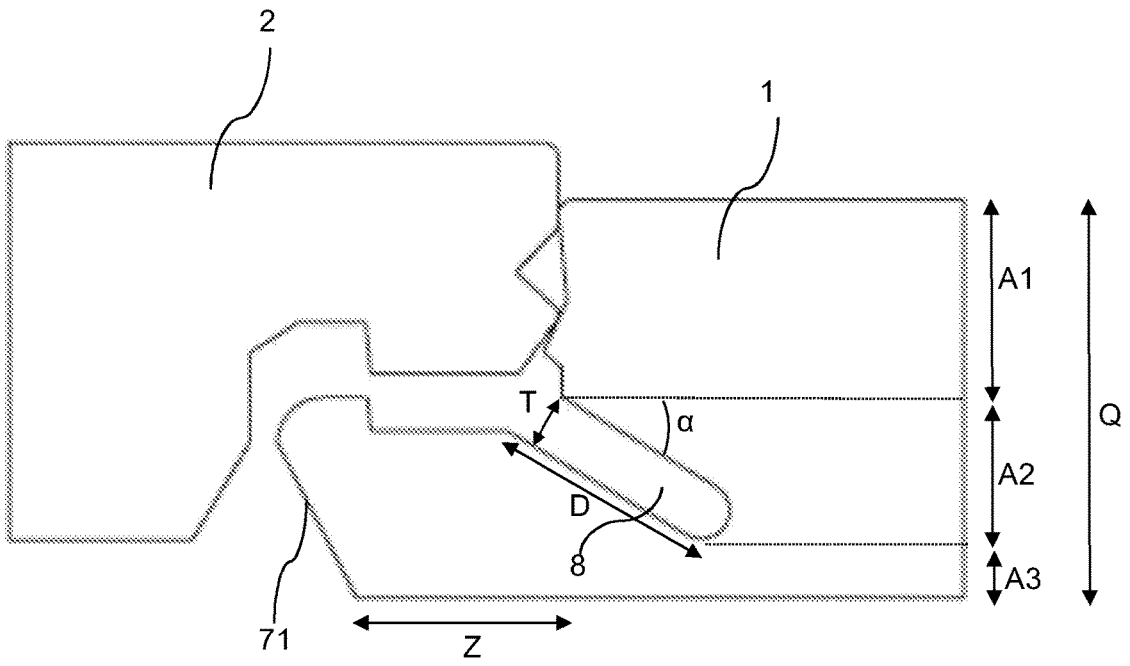
FIG. 3 shows a side view of an illustrative set in an unassembled state.

As shown for example in FIG. 3, the opening of the flexing groove 8 that is connected to the first edge 11 may be positioned at a distance A1 in a vertical direction from the first panel surface 12.

The distance A1 may be within the range of about 2 mm to about 7 mm, preferably about 3 mm to about 6 mm, more preferably about 4 mm to about 5 mm.

The bottom 81 of the flexing groove 8 may be positioned at a distance A3 in a vertical direction from the second panel surface 13. The distance A3 may be within the range of about 1 mm to about 7 mm, preferably about 1.25 mm to about 3 mm, more preferably about 1.5 mm to about 2 mm.

The flexing groove 8 may extend a distance A2 in a direction essentially perpendicular to the second panel surface 13, wherein A2 is equal to the distance Q minus the distance A1 minus the distance A3 ((Q)−(A1)−(A3)).

A ratio between the distance A2 and the distance A3 may be about 0.8 to about 3, preferably about 1 to about 2, more preferably about 1.25 to about 1.75. The ratios are high enough to allow an easy assembling and low enough to allow a sufficient locking strength. A ratio of 3 may provide an easier assembling and a ratio of 0.8 may provide a higher locking strength. The preferred value can depend on e.g. the material of the locking strip.

A ratio between the distance A2 and the distance A1 may be about 0.3 to about 1.2, preferably about 0.4 to about 0.9, more preferably about 0.5. The ratios are high enough to allow an easy assembling and low enough to reduce the risk of warping of the first and/or the second edge 11, 21 due to e.g. humidity changes and/or to allow for a sufficient locking strength in the vertical direction. A ratio of 3 may provide an easier assembling and a ratio of 0.8 may provide a higher locking strength in the vertical direction. The preferred value can depend on e.g. the material of the locking strip.

A ratio between the sum of the distance A2 plus the distance A3 and the distance Q (((A2)+(A3))/(Q)) may be about 0.2 to about 0.5, preferably about 0.25 to about 0.40, more preferably about 0.30 to about 0.35. The ratios are low enough to allow an easy assembling and high enough to reduce the risk of warping of the first and/or the second edge 11, 21 due to e.g. humidity changes and/or to allow for a sufficient locking strength in the vertical direction. A ratio of 0.2 may provide an easier assembling and a ratio of 0.5 may provide a higher locking strength in the vertical direction. The preferred value can depend on e.g. the material of the locking strip.

The mechanical locking device is configured to lock the first panel 1 and the second panel 2 in a first direction parallel to the first panel surface 12 and/or in a second direction perpendicular to the first panel surface 12.

The core of the first panel 1 and/or of the second panel 2 may be a wood-based core, preferably made of MDF, HDF, OSB, WPC, plywood or particleboard. The core may also be a plastic core comprising thermosetting plastic or thermoplastic e.g., vinyl, PVC, PU or PET. The plastic core may comprise fillers. The core may also be a mineral based board which may comprise e.g., MgO.

The first panel 1 and/or the second panel 2 may also be of solid wood.

The first panel 1 and/or the second panel 2 may be provided with a decorative layer, such as a foil or a veneer, on one or more surfaces.

The first panel 1 and the second panel 2 may be of a rectangular shape.

The first panel 1 may comprise an edge opposite the first edge which is essentially identical to the second edge of the second panel 2.

The second panel 2 may comprise an edge opposite the second edge which is essentially identical to the first edge of the first panel 1.

The first edge and the second edge may be short edges of the first panel and the second panel.

The assembling may also comprise an angling motion along a long side of the first panel and/or the second panel.

Further embodiments of the disclosure are described below:

1. A set of panels comprising a first panel (1), a second panel (2) and a mechanical locking device for locking the first panel (1) to the second panel (2), the mechanical locking device being configured for an assembly by a displacement of the second panel (2) in relation to the first panel (1) in a vertical direction to obtain a locked position of the first panel (1) and the second panel (2), wherein the first panel (1) comprises a first edge (11), a first panel surface (12) and a second panel surface (13) and the second panel (2) comprises a second edge (21), wherein the mechanical locking device comprises a locking strip (7) extending from the first edge (11) in a direction parallel to the first and second panel surfaces (12, 13), wherein the locking strip (7) comprises a locking strip edge (71), wherein the locking strip (7) comprises a first locking strip surface (72) extending in a direction substantially corresponding to the direction of the first panel surface (12) of the first panel (1), wherein the locking strip (7) comprises a second locking strip surface (73) extending in a direction substantially corresponding to the direction of the second panel surface (12) of the first panel (1), wherein the locking strip (7) comprises a locking element (3) configured to cooperate with a locking groove (4) at the second edge (21) of the second panel (2) for locking in a direction parallel to the first panel surface (12), wherein one of the first or second edge (11, 21) comprises a tongue (5) configured to cooperate with a tongue groove (6) at the other one of the first or second edge (11, 21) for locking in a vertical direction, wherein the mechanical locking device comprises a flexing groove (8) extending from a transition between the first locking strip surface (72) and the first edge (11) and into the first panel (1) at an angle (α) from the first panel surface (12), wherein the angle (α) is within the range of about 0° to about 30°, preferably within the range of about 0° to about 20°, more preferably within the range of about 0° to about 10°, even more preferably within the range of about 0° to about 5°, and wherein the locking strip (7) is configured to flex by varying a shape of the flexing groove (8) during the assembly, thereby increasing a flexibility of the locking strip (7) during the assembly.

2. The set of panels as described in embodiment 1, wherein an opening of the flexing groove (8) has a width T.

3. The set of panels as described in embodiment 2, wherein the width T of the opening of the flexing groove (8) is within the range of about 0.6 mm to about 2.5 mm, preferably about 0.8 mm to about 2.0 mm, more preferably about 1.6 mm.

4. The set of panels as described in any one of the previous embodiments 1-3, wherein a ratio between a width T of the opening of the flexing groove (8) and a distance Q between the first panel surface (12) and the second panel surface (13) is within the range of about 0.05 to about 0.4, preferably about 0.1 to about 0.3, more preferably about 0.15 to about 0.2.

5. The set of panels as described in any one of the previous embodiments 1-4, wherein the flexing groove (8) has a depth D that is within the range of about 2.5 mm to about 15 mm, preferably about 4 mm to about 12 mm, more preferably about 5 mm to about 10 mm, even more preferably about 7 mm.

6. The set of panels as described in embodiment 5, wherein a ratio between the depth D of the flexing groove (8) and the width T of the flexing groove (8) is about 2 to about 10, preferably about 3 to about 7, more preferably about 4.

7. The set of panels as described in any one of the previous embodiments 1-6, wherein the flexing groove (8) has a bottom (81).

8. The set of panels as described in embodiment 7, wherein a ratio between a length M of the bottom (81) of the flexing groove (8) and the width T of the opening of the flexing groove (8) is within the range of about 0.5 to about 2, preferably about 0.8 to about 1.4, more preferably about 1 to about 1.25.

9. The set of panels as described in any one of the previous embodiments 1-8, wherein the first locking strip edge (71) is positioned at a distance Z from the first edge (11), wherein Z is within the range of about 4 mm to about 12 mm, preferably about 6 mm to about 9 mm, more preferably about 7.5 mm to about 8.5 mm.

10. The set of panels as described in embodiment 9, wherein the ratio between the distance Z and the width T of the opening of the groove flexing (8) is within the range of about 2 to about 10, preferably about 4 to about 6, more preferably about 5.

11. The set of panels as described in any one of the previous embodiments 1-10, wherein the flexing groove (8) has a length L.

12. The set of panels as described in any one of the previous embodiments 1-11, wherein the first panel (1) comprises a third edge (14) and a fourth edge (15), the third edge (14) being at a distance TL from the fourth edge (15).

13. The set of panels as described in embodiment 12, wherein the length L of the flexing groove (8) extends from the third edge (14) of the first panel (1) to the fourth edge (15) of the first panel (1).

14. The set of panels as described in any one of the previous embodiments 1 to 13, wherein the flexing groove (8) has a fifth (82) edge and a sixth (83) edge, the fifth edge (82) being positioned at a distance X from the third (14) edge and the sixth edge (83) being positioned at a distance X from the fourth edge (15).

15. The set of panels as described in embodiment 14, wherein the distance X is within the range of about 1 mm to about 30 mm, preferably about 5 mm to about 20 mm, more preferably about 10 mm.

16. The set of panels as described in any one of the previous embodiments 1-15, wherein the bottom (81) of the flexing groove (8) is essentially arch shaped.

17. The set of panels as described in any one of the previous embodiments 1 to 15, wherein the bottom (81) of the flexing groove (8) is essentially triangular.

18. The set of panels as described in any one of the previous embodiments 1 to 15, wherein a cross-sectional shape of the flexing groove (8) is essentially rectangular or square.

19. The set of panels as described in any one of the previous embodiments 1-18, wherein the opening of the flexing groove (8) that is connected to the first edge (11) is positioned at a distance A1 in a vertical direction from the first panel surface (12).

20. The set of panels as described in embodiment 19, wherein the distance A1 is within the range of about 2 mm to about 7 mm, preferably about 3 mm to about 6 mm, more preferably about 4 mm to about 5 mm.

21. The set of panels as described in any one of the previous embodiments 1-21, wherein the bottom (81) of the flexing groove (8) is positioned at a distance A3 in a vertical direction from the second panel surface (13).

22. The set of panels as described in embodiment 21, wherein the distance A3 is within the range of about 1 mm to about 7 mm, preferably about 1.25 mm to about 3 mm, more preferably about 1.5 mm to about 2 mm.

23. The set of panels as described in embodiment 22, wherein the flexing groove (8) extends a distance A2 in a direction essentially perpendicular to the second panel surface (13), wherein A2 is equal to the distance Q minus the distance A1 minus the distance A3 ((Q)−(A1)−(A3)).

24. The set of panels as described in embodiment 23, wherein a ratio between the distance A2 and the distance A3 is about 0.8 to about 3, preferably about 1 to about 2, more preferably about 1.25 to about 1.75.

25. The set of panels as described in embodiment 23 or embodiment 24, wherein a ratio between the distance A2 and the distance A1 is about 0.3 to about 1.2, preferably about 0.4 to about 0.9, more preferably about 0.5.

26. The set of panels as described in any one of embodiments 23 to 25, wherein a ratio between the sum of the distance A2 plus the distance A3 and the distance Q(((A2)+(A3))/(Q)) is about 0.25 to about 0.5, preferably about 0.25 to about 0.40, more preferably about 0.30 to about 0.35.

27. The set of panels as described in any one of the previous embodiments 1-26, wherein the mechanical locking device is configured to lock the first panel 1 and the second panel 2 in a first direction parallel to the first panel surface 12 and/or in a second direction perpendicular to the first panel surface 12.

The invention claimed is:

1. A set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending in a direction substantially corresponding to the direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, wherein the mechanical locking device comprises a flexing groove extending from a transition between the first locking strip surface and the first edge and into the first panel at an angle from the first panel surface, wherein the angle is within the range of about 0° to about 30°, and wherein the locking strip is configured to flex by varying a shape of the flexing groove during the assembly, and wherein a ratio between a width T of an opening of the flexing groove and a distance Q between the first panel surface and the second panel surface is within the range of about 0.05 to about 0.4.

2. The set of panels as claimed in claim 1, wherein the width T of the opening of the flexing groove is within the range of about 0.6 mm to about 2.5 mm.

3. The set of panels as claimed in claim 1, wherein the flexing groove has a depth D that is within the range of about 2.5 mm to about 15 mm.

4. The set of panels as claimed in claim 3, wherein a ratio between the depth D of the flexing groove and the width T of the flexing groove is about 2 to about 10.

5. The set of panels as claimed in claim 1, wherein the flexing groove has a bottom.

6. The set of panels as claimed in claim 5, wherein a ratio between a length M of the bottom of the flexing groove and the width T of the opening of the flexing groove is within the range of about 0.5 to about 2.

7. The set of panels as claimed in claim 1, wherein the first locking strip edge is positioned at a distance Z from the first edge, wherein Z is within the range of about 4 mm to about 12 mm.

8. The set of panels as claimed in claim 7, wherein the ratio between the distance Z and the width T of the opening of the groove flexing is within the range of about 2 to about 10.

9. The set of panels as claimed in claim 1, wherein the flexing groove has a length L.

10. The set of panels as claimed in claim 1, wherein the first panel comprises a third edge and a fourth edge, the third edge being at a distance TL from the fourth edge.

11. The set of panels as claimed in claim 10, wherein the length L of the flexing groove extends from the third edge of the first panel to the fourth edge of the first panel.

12. The set of panels as claimed in claim 10, wherein the flexing groove has a fifth edge and a sixth edge, the fifth edge being positioned at a distance X from the third edge and the sixth edge being positioned at the distance X from the fourth edge.

13. The set of panels as claimed in claim 12, wherein the distance X is within the range of about 1 mm to about 30 mm.

14. The set of panels as claimed in claim 5, wherein the bottom of the flexing groove is essentially arch shaped.

15. The set of panels as claimed in claim 5, wherein the bottom of the flexing groove is essentially triangular.

16. The set of panels as claimed in claim 1, wherein a cross-sectional shape of the flexing groove is essentially rectangular or square.

17. The set of panels as claimed in claim 1, wherein the opening of the flexing groove that is connected to the first edge is positioned at a distance A1 in the vertical direction from the first panel surface.

18. The set of panels as claimed in claim 17, wherein the distance A1 is within the range of about 2 mm to about 7 mm.

19. The set of panels as claimed in claim 5, wherein the bottom of the flexing groove is positioned at a distance A3 in a vertical direction from the second panel surface.

20. The set of panels as claimed in claim 19, wherein the distance A3 is within the range of about 1 mm to about 7 mm.

21. The set of panels as claimed in claim 17, wherein the bottom of the flexing groove is positioned at a distance A3 in a vertical direction from the second panel surface, wherein the flexing groove extends a distance A2 in a direction essentially perpendicular to the second panel surface, and wherein A2 is equal to the distance Q minus the distance A1 minus the distance A3 ((Q)−(A1)−(A3)).

22. The set of panels as claimed in claim 21, wherein a ratio between the distance A2 and the distance A3 is about 0.8 to about 3.

23. The set of panels as claimed in claim 21, wherein a ratio between the distance A2 and the distance A1 is about 0.3 to about 1.2.

24. The set of panels as claimed in claim 21, wherein a ratio between the sum of the distance A2 plus the distance A3 and the distance Q (((A2)+(A3))/(Q)) is about 0.25 to about 0.5.

25. The set of panels as claimed in claim 1, wherein the mechanical locking device is configured to lock the first panel and the second panel in a first direction parallel to the first panel surface and/or in a second direction perpendicular to the first panel surface.

* * * * *